United States Patent [19]

Schneider

[11] 4,356,652

[45] Nov. 2, 1982

[54] PICTURE ALBUM

[76] Inventor: Friedrich C. Schneider, Frühlingstrasse 3, 8032 Gräfelfing, Fed. Rep. of Germany

[21] Appl. No.: 269,535

[22] Filed: Jun. 2, 1981

[30] Foreign Application Priority Data

Dec. 12, 1979 [DE] Fed. Rep. of Germany ..... 2949937
Jul. 9, 1980 [DE] Fed. Rep. of Germany ..... 3025973

[51] Int. Cl.[3] ..... G09F 19/00

[52] U.S. Cl. ..... 40/530; 40/405; 40/159

[58] Field of Search ..... 40/159, 158, 530, 405, 40/537

[56] References Cited

U.S. PATENT DOCUMENTS

| | | | |
|---|---|---|---|
| 1,952,732 | 3/1934 | Simon | 40/537 |
| 2,421,503 | 6/1947 | Hermon | 40/405 |
| 2,542,754 | 2/1951 | De Vry | 40/530 |
| 2,850,294 | 9/1958 | Ortis et al. | 40/159 |
| 3,174,244 | 3/1965 | Walton | 40/158 R |
| 3,651,591 | 3/1972 | Woodyard | 40/537 |
| 4,172,332 | 10/1979 | Holes et al. | 40/159 |
| 4,275,517 | 6/1981 | Blanchard | 40/159 |

*Primary Examiner*—Paul J. Hirsch
*Assistant Examiner*—Wenceslao J. Contreras

[57] ABSTRACT

A picture album comprising picture carriers which are formed by flat cells of double-walled plastic film, the flat cells being filled with an elastic material and being joined together by strip-like weld areas which form a folding hinge means. According to the invention each two flat cells are joined by a weld area to form double flat cell arrangements. Further there is formed in the weld area of a double flat cell arrangement, an insertion opening which extends in the longitudinal direction of the weld area, for at least one further double flat cell arrangement, and there is provided in the weld area of the further double flat cell arrangement a respective slot extending inwardly thereof from each of the upper and lower edges whereby a plurality of double flat cell arrangements are adapted to be joined together to constitute a book form by insertion of at least one of the further double flat cell arrangements into the insertion opening.

7 Claims, 5 Drawing Figures

Figure 3:
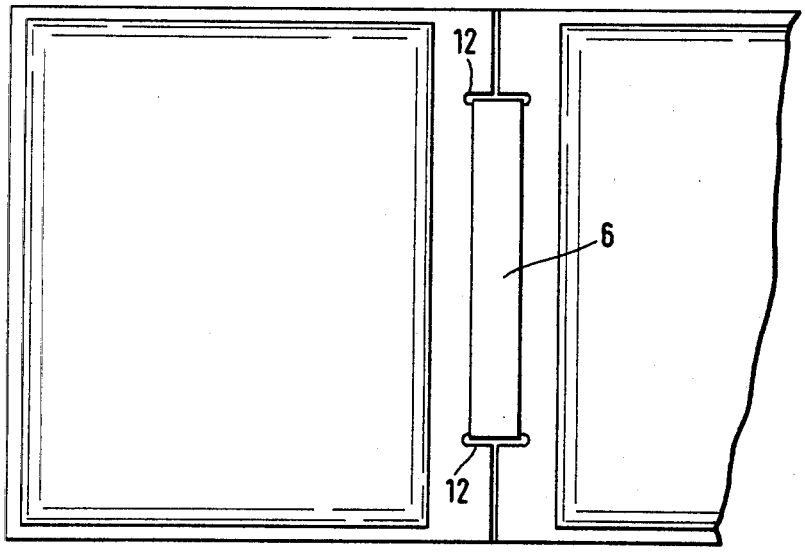

FIG. 1
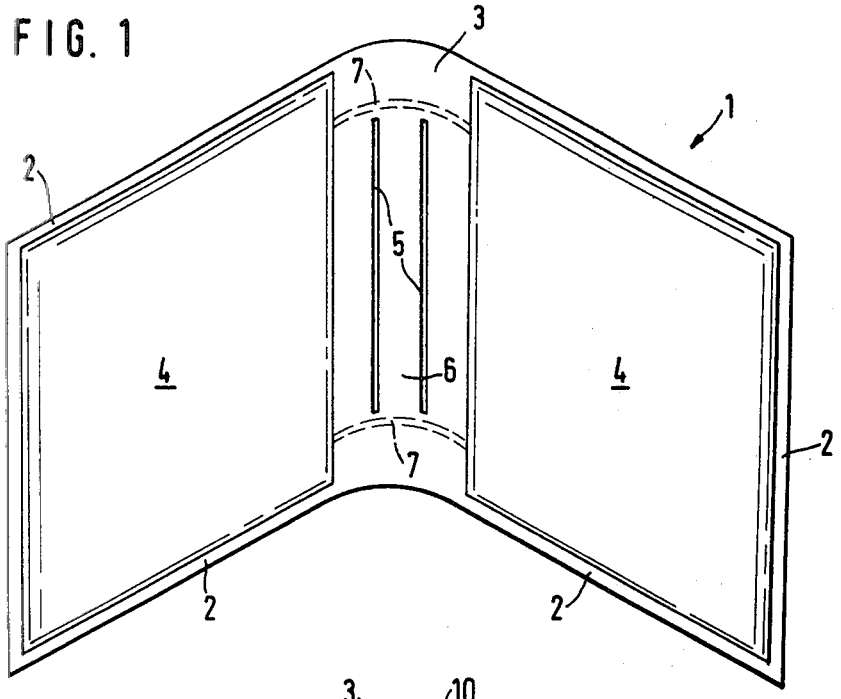
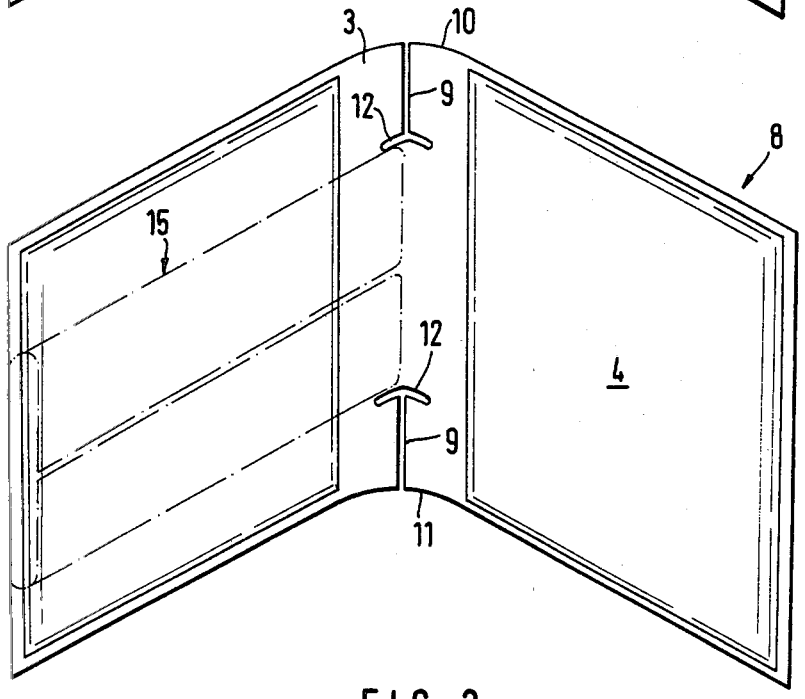
FIG. 2

FIG. 4
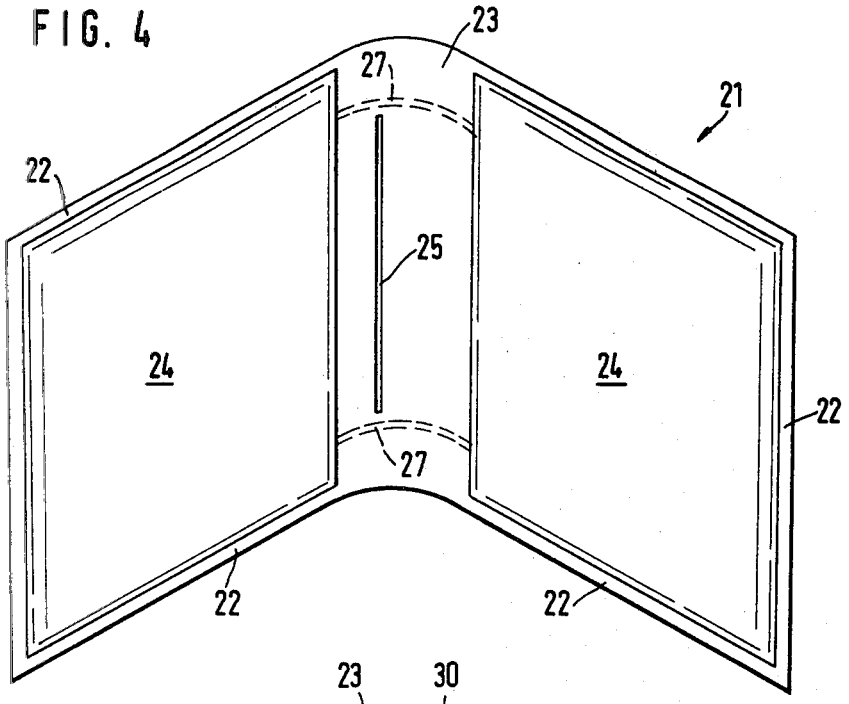
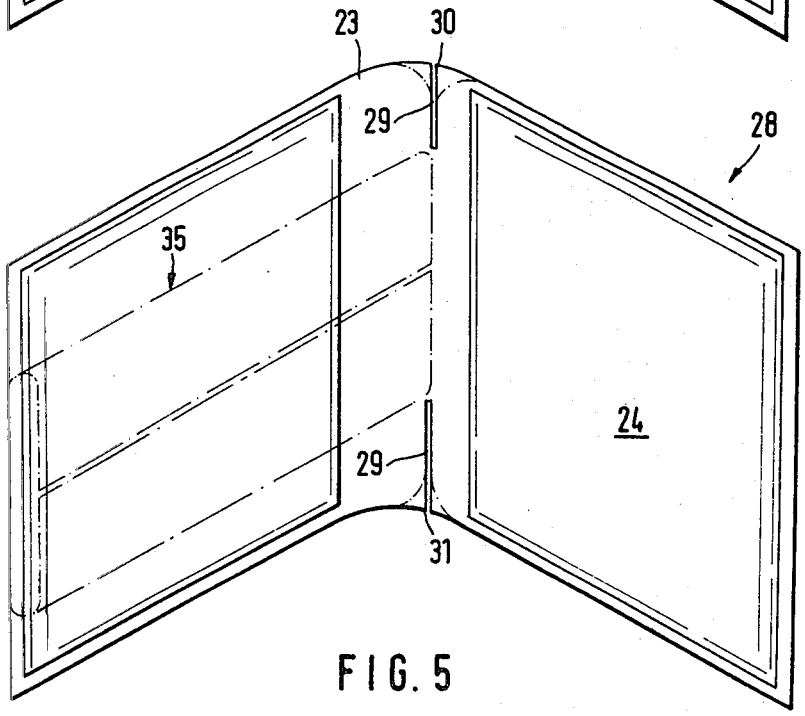
FIG. 5

PICTURE ALBUM

The invention relates to a picture album, comprising picture carriers which are formed by flat cells or pockets of double-walled plastic film or foil, the flat cells being filled with an elastic filling material and being joined together by strip-like weld areas or surfaces which form a folding hinge means.

In a known picture album of the above-indicated kind (German patent specification No. 1 246 486), the individual flat cells which represent the picture carriers of the album are formed by elongate double-layer plastic film strips or bands being welded together at their edges, with a strip of foam material therebetween, and being subdivided into individual sections which form the flat cells or pockets, by the above-mentioned weld areas which extend transversely with respect to the strip or band direction. In order to facilitate the folding operation, the weld areas or surfaces are additionally provided with a weld line forming a hinge means. The known picture album of this configuration can only be folded in a concertina-like manner, giving the advantage that it can be completely and satisfactorily cleaned. This is a factor of considerable significance from the hygiene point of view, in particular for young children.

Instead of the concertina-like manner of folding, there is a desire to market a picture album of the above-indicated kind which is also in conventional book form and in which the individual picture carriers are jointly connected together at one side. This increases the attraction and incentive for children as they see a model of this in adult books.

Theoretically, it would also be possible for the flat cells or pockets of the known picture album to be joined along one side by a common weld seam, to form a book of conventional configuration. This however would involve foregoing the advantage of such a picture album being unobjectionable from the hygiene point of view, because experience has shown that, even when such a picture album is opened, the regions of the individual pages which are directly adjacent the weld seam are virtually totally inaccessible for cleaning, so that dirt, pieces of food and other substances which produce a breeding ground for bacteria can accumulate there. With a picture album of the kind referred to herein, this disadvantage is all the more serious insofar as a common weld seam, depending on the number of pages or sheets which are put together to form the book, has to extend through multiple layers of film and therefore the resulting book spine is comparatively rigid.

A further disadvantage is that in a process for producing such an album, it is necessary to weld a seam which extends through the multiple layers of plastic film and which must be precisely adjusted so that none of the individual layers of plastic film is overheated, which could have the result that the interconnected flat cells could come apart from each other.

Therefore, an object of the present invention is to provide a picture book or album of the general kind set forth at the beginning of this specification, which is of conventional book form with pages or sheets which are joined together at one side to form a spine, without however losing the important advantage that the book or album can be satisfactorily cleaned.

To achieve this object, the present invention provides a picture book or album, the picture carriers of which are formed by flat cells of double-walled plastic film or foil, which cells are filled with an elastic filling material and are joined together by strip-type weld areas forming a folding hinge means, wherein each two flat cells are joined by a weld area to form double flat cell arrangements, wherein there is formed in the weld area of a double flat cell arrangement, an insertion opening which extends in the longitudinal direction of the weld area, for at least one further double flat cell arrangement, and wherein there is provided in the weld area of the further double flat cell arrangement a respective slot extending inwardly thereof from the upper and lower edges respectively so that a plurality of double flat cell arrangements are joined together to constitute a book form by insertion of at least one of the further double flat cell arrangements into the insertion opening.

There are two basic forms in which the principles of the present invention may be embodied:

In a first embodiment, the insertion opening may be formed in the weld area of the first double flat cell arrangement by means of a loop portion which is formed by two slots which extend in the longitudinal direction of the weld area and which are closed at both ends. This first double flat cell arrangement is joined to the further double flat cell arrangements, to form a book-like configuration, by a respective flat cell of the further double flat cells which are provided with the slots extending inwardly from the upper and lower edges being folded together and pushed through under the loop portion of the first-mentioned double flat cell arrangement. By virtue of the elasticity of the flat cells, which is due to the use of the plastic films or foils and the elastic filling material, the individual pages or sheets satisfactorily resume a flat condition when they are released after having been folded together. The loop portion now engages into the slot formed between the flat cells of each double flat cell arrangement, and firmly secures it in position.

In a second embodiment of the invention, the insertion opening is formed only by one slot, which is closed at both ends, in the weld area, so that the double flat cell arrangements are fitted into each other in a crossed configuration and can thereby be joined together to constitute a book form.

As no inaccessible gaps can be formed at the spine of the book when the two connecting methods described above are used, it is possible for the picture album to be cleaned even when the individual double flat cell arrangements are in the condition of being joined together. However, satisfactory cleaning is achieved at least when the individual pages or sheets, that is to say, the double flat cell arrangements, are in a separated condition, which is achieved by again folding a flat cell and pulling it out from under the loop portion or pulling it through the slot-like insertion opening.

Embodiments of the picture album according to the present invention are described in greater detail hereinafter with reference to the accompanying drawings in which:

FIG. 1 shows a perspective view of a double flat cell of the picture album, in a first embodiment, which has a loop, FIG. 2 shows a perspective view of a double flat cell of the picture album, with the slots which project in from the edge of the welded area, FIG. 3 shows a plan view of a picture album in the connected and opened condition of the two double flat cells shown in FIGS. 1 and 2, FIG. 4 shows a perspective view of a double flat cell of the picture album, in a second embodiment, which has an insertion opening, and FIG. 5 shows a perspective view of a double flat cell of the picture album provided with the slots which project in from the edge of the welded area.

The double flat cell shown in FIG. 1, which is generally denoted by reference numeral 1, comprises two superposed plastic film or foil strips with an interposed elastic and weldable foam material, which are welded together by means of weld lines 2 formed along the edges thereof. An additional welded surface or area 3 which extends transversely with respect to the longitudinal dimension of the film strips and which is considerably wider than the weld lines 2 results in the formation, on both sides of the weld area 3, of flat cells or pockets 4 which are filled with the unchanged elastic foam material so that the film strips do not lie in contact against each other, thus resulting in a certain bulge which can be seen from the drawing. The structure of the flat cells and the interconnection thereof by the weld area 3 corresponds moreover to the teaching of German patent specification No. 1 246 486 and therefore does not need to be described in greater detail herein.

Provided in the weld area 3 are two slots 5 which extend parallel to each other and which pass completely through the plastic material, thereby forming a movable loop 6. The width of the loop 6 is approximately equal to the regions of the weld area 3 which remain on both sides of the loop. The ends of the slots are prevented from tearing out by means of reinforcing ribs 7 which are formed on the rear surface of the weld area 3 and which are produced by virtue of the outward plastic films not being welded together at that point, but instead a portion of foam material which has not been melted remains therebetween. If necessary, instead of the two reinforcing ribs 7 shown in the drawing, it would also be possible to provide further ribs which are uniformly distributed over the height of the weld area 3. It is also possible for the reinforcing ribs 7 to be disposed at the same time or exclusively on the inside of the double flat cell 1, which can be seen in FIG. 1.

The double flat cell shown in FIG. 2, which is generally denoted by reference numeral 8, is of the same structure as the arrangement 1 shown in FIG. 1, and differs therefrom only by the arrangement of slots 9 in the weld area 3, which are provided instead of the slots 5. The slots 9 are open to the upper edge 10 and the lower edge 11 respectively of the weld area 3 and at their inward end go into an opening 12 which extends transversely with respect to the longitudinal direction of the respective slots and which is laterally rounded. The opening 12 is approximately slot-shaped. The slots 9 are of equal length and their length corresponds at least to the distance between the ends of the slot 5 and the associated edges in the double flat cell arrangement 1.

The picture album according to the invention is formed from the double flat cells 1 and 8 by one flat cell 4 of the double flat cell arrangement 8 being folded in from both sides, as illustrated by dash-dotted lines at 15 in FIG. 2. Because, as already mentioned, the length of the slots 9 corresponds at least to the spacing of the ends of the slots 5 from the upper and lower edges of the weld area 3, the total width of the flat cell can be so reduced, by the folding operation, that the flat cell can be pushed through under the loop 6. By virtue of the resilient reaction in particular of the foam material in the flat cell, the flat cell resumes its originally flat configuration immediately the folds are released. Because of this, the loop 6, in the region of its points of origin at the weld area 3, fits into the openings 12 at the ends of the slots 9 and thereby holds the double flat cell arrangement 8 fixedly connected to the double flat cell arrangement 1. As the openings 12 are of slot-like configuration, they hold the inward double flat cell arrangement 8 firmly and prevent rotational movement thereof, thereby satisfactorily ensuring that the assembly is always in book form (see FIG. 3).

The double flat cell shown in FIG. 4, which is generally denoted by reference numeral 21, comprises two superposed plastic film or foil strips with elastic and weldable foam material laid therebetween, which are welded together forming weld lines 22 along their edges. An additional weld surface or area 23 which extends transversely with respect to the longitudinal dimension of the film strips and which is considerably wider than the weld lines 22 results in flat cells 24 being formed on both sides of the weld area 23. The flat cells 24 are filled with the unchanged elastic foam material so that the film strips do not lie in contact against each other, producing a certain bulge which can be seen from the drawing. The structure of the flat cells and the interconnection of the flat cells by means of the weld area 3 corresponds to the teaching of German patent specification No. 1 246 486 and therefore does not need to the described in detail herein.

Provided in the weld area 23 is a slot 25 which extends in the longitudinal direction thereof and which passes completely through the plastic material, forming an insertion opening. The ends of the slot 25 are prevented from tearing out by means of reinforcing ribs 27 which are formed on the rear of the weld area 23 and which are produced by the outward plastic films not being welded together at that point, but instead a portion of foam material which has not been melted remains therebetween. If necessary, instead of the two reinforcing ribs 27 illustrated in the drawing, it would also be possible to provide further ribs which are uniformly distributed over the height of the weld area 23. It is also possible for the reinforcing ribs 27 to be arranged at the same time or exclusively on the inside of the double flat cell arrangement 21, as seen in FIG. 4.

As can be seen from FIG. 4, the slot 25 is displaced towards the left relative to the vertical centre line of the weld area 23. In this way, the portion of the weld area 23 which is beside the slot 25 on the right-hand side thereof is larger than that on the left of the slot.

The double flat cell arrangement shown in FIG. 5, which is generally denoted by reference numeral 28, is of the same structure as the double flat cell arrangement 21 and differs therefrom only by virtue of the provision of slots 29 in the weld area 23, instead of the slot 25. The slots 29 are open to the upper edge 30 and the lower edge 31 respectively of the weld area 23. At their inward ends, the slots 29 can be particularly strengthened by a spot weld. The slots 29 are of equal length; the distance between their inward ends is no greater than the length of the slot 25 in the double flat cell arrangement 21. If it is desired that the double flat cell arrangements 21 and 28 should align with each other when they are fitted together, which is usually the case, the length of the slots 29 also corresponds to the spacing of the ends of the slot 25 from the upper and lower edges respectively of the associated weld area 23.

The picture album according to the invention is formed from the double flat cell arrangements 21 and 28 by the one flat cell 24 of the double flat cell arrangement 28 being folded in from both sides, as indicated at 35 by the dash-dotted lines in FIG. 5. As the distance between the inward ends of the slots 29 is no greater than the length of the slot 25 in the flat cell arrangement 21, as already mentioned above, the total width of the flat cell 24 can be so reduced, by the folding operation, that the flat cell can be pushed through the slot 25. Because of the resilient reaction in particular of the foam material in the flat cell, the flat cell resumes its originally flat configuration as soon as the folds are released. That causes the parts of the weld area which remained outside the ends of the slot 25, which is closed at both ends, and which extend to the upper and lower edges respectively, to fit into the two slots 29 whereby the double flat cell arrangement 28 is positively connected to the double flat cell arrangement 21 in book form.

As, as can be seen from FIG. 5, the pair of slots 29 are disposed at a position which is displaced towards the right in the drawing from the vertical centre line of the double flat cell arrangement, the portion of the associated weld area 23 which is to the left of the slots 29 is larger than that which is to the right of the slots. The result of this is that, after the double flat cell arrangements 21 and 28 are fitted together in the crossed mode described and illustrated, the flat cells 24 with the respective longer portions of the adjoining weld areas 23 are disposed adjacent each other so that their left-hand and right-hand outer edges respectively project beyond the other pair 24 of flat cells, when the album is closed. The projecting flat cells thereby form the cover of the picture album.

It may be possible for the corner edges formed by the slots 29 in the double flat cell arrangement 28 to be rounded off, as indicated in dash-dotted lines in FIG. 5.

By virtue of the elastic properties of the materials used, the double flat cell arrangements may be fitted together and disengaged from each other as often as may be required. In the condition in which the two flat cell arrangements are separated from each other, the flat cell arrangements can be completely cleaned, which is absolutely necessary from the point of view of hygiene requirements. In addition, by virtue of the illustrated connection, the individual pages of the picture album may be fully opened out, without a resilient reaction which tends to cause them to close, so that the pages of the album can also be turned over and the album can be viewed, without the need for the album to be held open. This would not be the case if the individual pages of the book were welded up to form a spine.

What is claimed is:

1. A picture album comprising picture carriers which are formed by flat cells of double-walled plastic film, the flat cells being filled with an elastic material and being joined together by strip-like weld areas which form a folding hinge means, characterised in that each two flat cells are joined by a weld area to form double flat cell arrangements, that there is formed in the weld area of a double flat cell arrangement, an insertion opening which extends in the longitudinal direction of the weld area, for at least one further double flat cell arrangement, and that there is provided in the weld area of the further double flat cell arrangement a respective slot extending inwardly thereof from each of the upper and lower edges whereby a plurality of double flat cell arrangements are adapted to be joined together to constitute a book form by insertion of at least one of the further double flat cell arrangements into the insertion opening.

2. A picture album as set forth in claim 1 characterised in that said insertion opening is formed in the weld area (3) of a double flat cell arrangement (1) by a loop picture (6) which is formed by two slots (5) which extend in the longitudinal direction of the weld area and which are closed at both ends.

3. A picture album as set forth in claim 1 characterised in that the insertion opening is formed by a slot (25) which is closed at both ends, whereby the double flat cell arrangements (21 and 28) are adapted to be fitted into each other in a crossed configuration and can thereby be joined together to constitute a book form.

4. A picture album as set forth in claim 2 characterised in that the slots (9) which project in from the edge of the weld area are enlarged at their closed end to form a preferably rounded opening (12).

5. A picture album as set forth in claim 2 characterised in that the loop portion (6) is arranged symmetrically with respect to the longitudinal axis of the weld area (3) and the slots (9) extending from the edge thereof are of equal length.

6. A picture album as set forth in claim 3 characterised in that the slot (25) which is closed at both ends, in one double flat cell arrangement (21), is disposed at a position which is displaced towards one side relative to the centre of the associated weld area (23), and the two slots (29) of the further double flat cell arrangement (28) are disposed at a position which is displaced towards the opposite side relative to the centre of the weld area (23) thereof.

7. A picture album as set forth in claim 6 characterised in that the slot (25) which is closed at both ends, in said one double flat cell arrangement, and the two slots (29) in said further double flat cell arrangement are displaced by the same extent out of the centre of the associated weld area (23).

* * * * *